US008974239B2

(12) United States Patent
Tomimbang

(10) Patent No.: US 8,974,239 B2
(45) Date of Patent: Mar. 10, 2015

(54) TAMPER RESISTANT SHUTTER DEVICE FOR ELECTRICAL RECEPTACLE OUTLETS

(76) Inventor: Wendell E. Tomimbang, Kissimmee, FL (US)

( * ) Notice: Subject to any disclaimer, the term of this patent is extended or adjusted under 35 U.S.C. 154(b) by 151 days.

(21) Appl. No.: 13/600,182

(22) Filed: Aug. 30, 2012

(65) Prior Publication Data

US 2014/0065862 A1 Mar. 6, 2014

(51) Int. Cl.
*H01R 13/44* (2006.01)
*H01R 13/453* (2006.01)
*H01R 13/447* (2006.01)

(52) U.S. Cl.
CPC ..... *H01R 13/4538* (2013.01); *H01R 13/447* (2013.01)
USPC ..... 439/140

(58) Field of Classification Search
CPC ..... H01R 13/453; H01R 13/4538; H01R 13/447; H01R 13/4534; H01R 13/4536; H01R 13/4532; H01R 13/652
USPC ..... 439/140, 106, 107
See application file for complete search history.

(56) References Cited

U.S. PATENT DOCUMENTS 2,226,148 A * 12/1940 Taylor ..... 439/682
2,450,467 A * 10/1948 Clark ..... 439/638
2,487,560 A * 11/1949 Kuhn ..... 439/131
2,531,625 A * 11/1950 Hubbell ..... 200/51.09
2,540,496 A * 2/1951 Sperrazza ..... 200/51.09
2,545,536 A * 3/1951 Von Holtz ..... 439/137
2,553,837 A * 5/1951 Von Holtz ..... 439/137
3,214,726 A * 10/1965 Cardenas et al. ..... 439/673
3,596,019 A * 7/1971 Koester ..... 200/51.09
3,980,371 A * 9/1976 Kahn et al. ..... 439/137
5,267,870 A * 12/1993 Maresh ..... 439/139
6,135,802 A * 10/2000 Nakamura ..... 439/352
6,568,942 B2 * 5/2003 Lau et al. ..... 439/39
6,780,031 B1 * 8/2004 Valls ..... 439/147
6,969,801 B2 * 11/2005 Radosavljevic et al. ..... 174/53
7,114,968 B2 * 10/2006 Healy ..... 439/137
7,179,992 B1 * 2/2007 Packard et al. ..... 174/53
7,234,954 B1 * 6/2007 Srage et al. ..... 439/222
7,312,394 B1 * 12/2007 Weeks et al. ..... 174/53
7,355,117 B2 * 4/2008 Castaldo et al. ..... 174/53
7,452,221 B1 * 11/2008 Oddsen et al. ..... 439/137
7,455,538 B2 * 11/2008 Germain ..... 439/137

(Continued)

*Primary Examiner* — Abdullah Riyami
*Assistant Examiner* — Vladimir Imas
(74) *Attorney, Agent, or Firm* — The Miller Law Offices PLC; Steven J. Miller, Esq.

(57) ABSTRACT

To prevent electrocution from improper connections through electrical outlets including Arc Fault Circuit Interrupters (commonly known as AFCI's), Ground Fault Circuit Interrupters (commonly known as GFCI's) and power strips, plugs of matching configuration should be used. For purposes of this application, "electrical outlet" or "receptacle outlet" have the same meaning as an "outlet". When unattended, some children could be electrocuted by inserting metallic objects into electrical outlets. To control these incidents, it becomes necessary to provide outlets with a shutter device incorporated into the housing cover so that only plugs of matching configuration can be used. For purposes of this application, "childproof", "tamper-proof" or "tamper-resistant" outlets are the same and refer to an outlet provided with a shutter device as the present invention. These shutter devices are typically incorporated into the outlet housing cover to resist tampering or entry of any object other than a plug of matching configuration.

14 Claims, 21 Drawing Sheets

(56) References Cited

U.S. PATENT DOCUMENTS

| | | | | |
|---|---|---|---|---|
| 7,554,033 | B1 * | 6/2009 | Bhosale et al. | 174/53 |
| 7,642,457 | B2 * | 1/2010 | Weeks et al. | 174/53 |
| 7,651,347 | B2 * | 1/2010 | Germain et al. | 439/137 |
| 7,736,174 | B2 * | 6/2010 | Bhosale et al. | 439/490 |
| 7,790,982 | B2 * | 9/2010 | Weeks et al. | 174/50 |
| 7,820,909 | B2 * | 10/2010 | Castaldo et al. | 174/53 |
| 7,868,719 | B2 * | 1/2011 | Bazayev et al. | 335/18 |
| 7,967,620 | B1 * | 6/2011 | Baldwin et al. | 439/188 |
| 8,044,299 | B2 * | 10/2011 | Weeks | 174/53 |
| 8,187,011 | B1 * | 5/2012 | Baldwin et al. | 439/137 |
| 8,187,012 | B1 * | 5/2012 | Baldwin et al. | 439/137 |
| 8,242,362 | B2 * | 8/2012 | Castaldo et al. | 174/53 |
| 8,491,319 | B1 * | 7/2013 | Baldwin et al. | 439/137 |
| 8,568,152 | B1 * | 10/2013 | Weeks | 439/137 |
| 2009/0236115 | A1 * | 9/2009 | Li | 174/53 |
| 2010/0041259 | A1 * | 2/2010 | Ni | 439/137 |

* cited by examiner

NOTE: GROUND PIN LOCKOUT RELEASE MECHANISM ENABLED IN WHICH THE GROUND PIN LOCKOUT INSERT IS NOT APPLIED

NOTE: GROUND PIN LOCKOUT RELEASE MECHANISM DISABLED IN WHICH THE GROUND PIN LOCKOUT INSERT IS APPLIED

NOTE: GROUND PIN LOCKOUT RELEASE MECHANISM ENABLED IN WHICH THE LOCKOUT INSERT IS NOT APPLIED

NOTE: GROUND PIN LOCKOUT RELEASE MECHANISM DISABLED IN WHICH THE LOCKOUT INSERT IS APPLIED

TAMPER RESISTANT SHUTTER DEVICE FOR ELECTRICAL RECEPTACLE OUTLETS

CROSS-REFERENCE TO RELATED APPLICATIONS

None.

FIELD OF THE INVENTION

The present invention relates to a tamper-resistant shutter device incorporated into an outlet housing cover to prevent insertion of any object into an electrical outlet except a plug of matching configuration.

BACKGROUND OF THE INVENTION

Electrical outlets including AFCI, GFCI, power strips, and extension cords are used to connect portable appliances and other electrical equipment. Most of the commonly available outlets are not protected from improper connections and entry of foreign metallic objects causing a major concern for the safety of users especially children or inexperienced individuals. To control said improper connections, a mechanism, device or assembly so configured to resist the entry of any object other than a plug that matches the configuration and geometry of the outlet could be incorporated into the outlet housing cover. In North America, outlets are configured according to their voltage and current ratings and referred to as the National Electrical Manufacturers Association configurations or commonly known as NEMA configurations. The most common household electrical outlet configurations are the NEMA 1-15R, 2-15R, 2-20R, 5-15R 50, 5-20R 51, 6-15R 52 and 6-20R 53, respectively for 125V/15A ungrounded, 250V/15A ungrounded, 250V/20A ungrounded, 125V/15A with ground, 125V/20A with ground, 250V/15A with ground and 250V/20A with ground. Electrical plugs NEMA 1-15P 43, 2-15P 44, 2-20P 45 may be used with outlets of the same configuration with or without ground. For purposes of this patent application, the term "ungrounded" refers to a plug or a receptacle outlet without ground connection, whereas the term "grounded" refers to a plug or receptacle outlet with ground connection.

There are electrical outlets provided with tamper-resistant shutters commercially available, however, most of them are limited to two configurations including the most common NEMA 1-15R and 5-15R 50. Most prior art designs do not provide total tampering protection for outlets with ground. The NEMA 1-15R is similar to the NEMA 5-15R 50 except that it has no ground connection.

With the limited protection and features offered by prior art designs, there is always a possibility to develop a better and more effective tamper-resistant shutter device for electrical outlets as with the present invention.

The present invention would apply to at least 7 different electrical outlet configurations including NEMA 1-15R, 2-15R, 2-20R, 5-15R 50, 5-20R 51, 6-15R 52 and 6-20R 53. For purposes of this patent application, specific NEMA outlet configurations are used, however, the same principles, methods and techniques may be used for other configurations including those used in other countries and standards.

The present invention affords protection for multiple outlet configurations and saves production costs and tooling. The present invention ensures an effective tamper-resistant protection by allowing only plugs of matching configuration to be used with the outlet, avoiding electrocution or other harmful incidents. For someone to use anything but the proper plug, it would require knowledge of the operating mechanisms of the present invention to articulate the geometry of a matching plug. The present invention employs multiple levels of protection through interlocked mechanisms so the device would only operate when both plug blades are inserted simultaneously. In case of a grounded plug, the present invention includes a ground pin lockout release mechanism 34 so the shutters to the electrical outlet only open when a matching plug configuration is used.

U.S. Pat. No. 7,452,221B1 (November/2008 Oddsen et al) disclosed a shutter device for a NEMA 5-15R electrical outlet different from the present invention which is designed to accommodate multiple configurations with and without ground. The Oddsen et al patent also refers to a shutter device relying on a sliding and pivotal movement of shutter members through a side frame to position the openings in the shutter plate with the outlet contacts. This is different from the present invention which uses wedge-driven positioning members to release locking mechanisms.

U.S. Pat. No. 7,312,394B1 (December/2007 Weeks et al) disclosed a shutter device for a limited configuration different from the present invention which accommodates multiple configurations, with and without ground. The Weeks et al patent also refers to a shutter device with a stationary positioning member and the other moving in the same plane but in opposite direction. This is different from the present invention which uses wedge-driven positioning members to release locking mechanisms for the plug to be used with the outlet. The ground pin release mechanism disclosed in the Weeks et al patent is offset from the center of the assembly due to space limitations, whereas the present invention employs a ground-pin lockout release mechanism directly at the centerline of the shutter frame. This is made possible by the space-saving configuration disclosed in the present invention.

U.S. Pat. No. 7,868,719B2 (January/2011 Bazayev et al) disclosed a shutter device for a limited outlet configuration different from the present invention which is designed to accommodate multiple configurations, with and without ground. The Bazayev et al patent also refers to a shutter device with two similar sliding plates moving in unison to align the plug blades with the receptacle outlet contact points which is different from the present invention which uses wedge-driven positioning members to release locking mechanisms to open access holes for the plug to be used with the outlet. The Bazayev et al patent also did not disclose any provision for ground-pin lockout release mechanism, which is provided with the present invention.

US2010/0041259 A1 (February/2010 Ni) disclosed a shutter device for NEMA 5-15R and 5-20R electrical outlets different from the present invention which is designed to accommodate multiple configurations, with and without ground. The Ni patent refers to a shutter device with independently movable spring-activated elements which differ from the present invention using wedge-driven positioning members to release locking mechanisms for the plug to be used with the outlet. The Ni patent did not disclose any provision for ground-pin lockout release mechanism, which is provided with the present invention.

US2009/0236115 A1 (September/2009 Li) disclosed a shutter device for a NEMA 5-15R electrical outlet different from the present invention which is designed to accommodate multiple configurations, with and without ground. The Li patent refers to a shutter device with two opposing spring-activated members overlaid against each other through their side openings to resist tampering. The present invention is framed and wedge-driven positioning members are used to release locking mechanisms to access the outlet. The Li patent did not disclose any provision for ground-pin lockout release mechanism which is provided with the present invention.

SUMMARY OF THE INVENTION

The present invention is focused on providing a safe, reliable and cost-effective means to avoid dangerous access to electrical outlets by children or inexperienced individuals. This is possible through the use of a tamper-resistant shutter device incorporated into an outlet housing cover. The mechanism may be used as accessory for outlet housing covers for AFCI, GFCI, power strips, extension cords and portable outlets. The present invention ensures that outlet contacts remain covered and only become accessible when a plug that matches the outlet configuration is used. To withstand reasonable usage and allow independent assembly, the shutter device is framed.

The present invention employs multiple interlocked wedge-driven positioning members to ensure a total tamper-resistant protection by allowing only plugs of matching configuration to be used with the electrical outlet. This poses a challenge for a child or any user to tamper with the device, avoiding electrocution or other harmful incidents. For someone to use anything but the proper plug, it would require knowledge of the operating mechanism of the present invention to articulate the geometry of the plug blades and ground pin. The wedge-driven positioning members ensure the shutters would only open when both blades of the plug are inserted simultaneously. The cover to the access holes on the frame only opens when the shutters are displaced a calculated distance to align with the outlet contact points. These wedge-driven positioning members are maintained in a default "closed position" by springs and stoppers when no plug is used with the outlet.

Certain standard NEMA outlet configurations are cited for reference in the present invention, however, adopting the same principles, methods or techniques for other configurations or styles used in other countries and standards will attain the same objective.

Not limiting the scope of the present invention, one skilled in the art may recognize the methods disclosed could apply to any other applications not mentioned herein with similar objectives.

BRIEF DESCRIPTION OF THE DRAWINGS

FIG. 1 shows some of the most common NEMA outlets with matching plug configurations, with and without ground, which the present invention could be used on.

DETAILED DESCRIPTION OF EMBODIMENTS

References will now be made in detail to describe the exemplary embodiments of the present invention, which are illustrated in the accompanying drawings. Details disclosed herein are not to be interpreted as limiting, but rather as basis for the claims and teaching one skilled in the art how the present invention could be employed in any appropriately detailed system, structure or manner. Wherever possible, the same reference numbers will be used throughout the drawings to refer to the same or like components, or functions.

Figure 1:
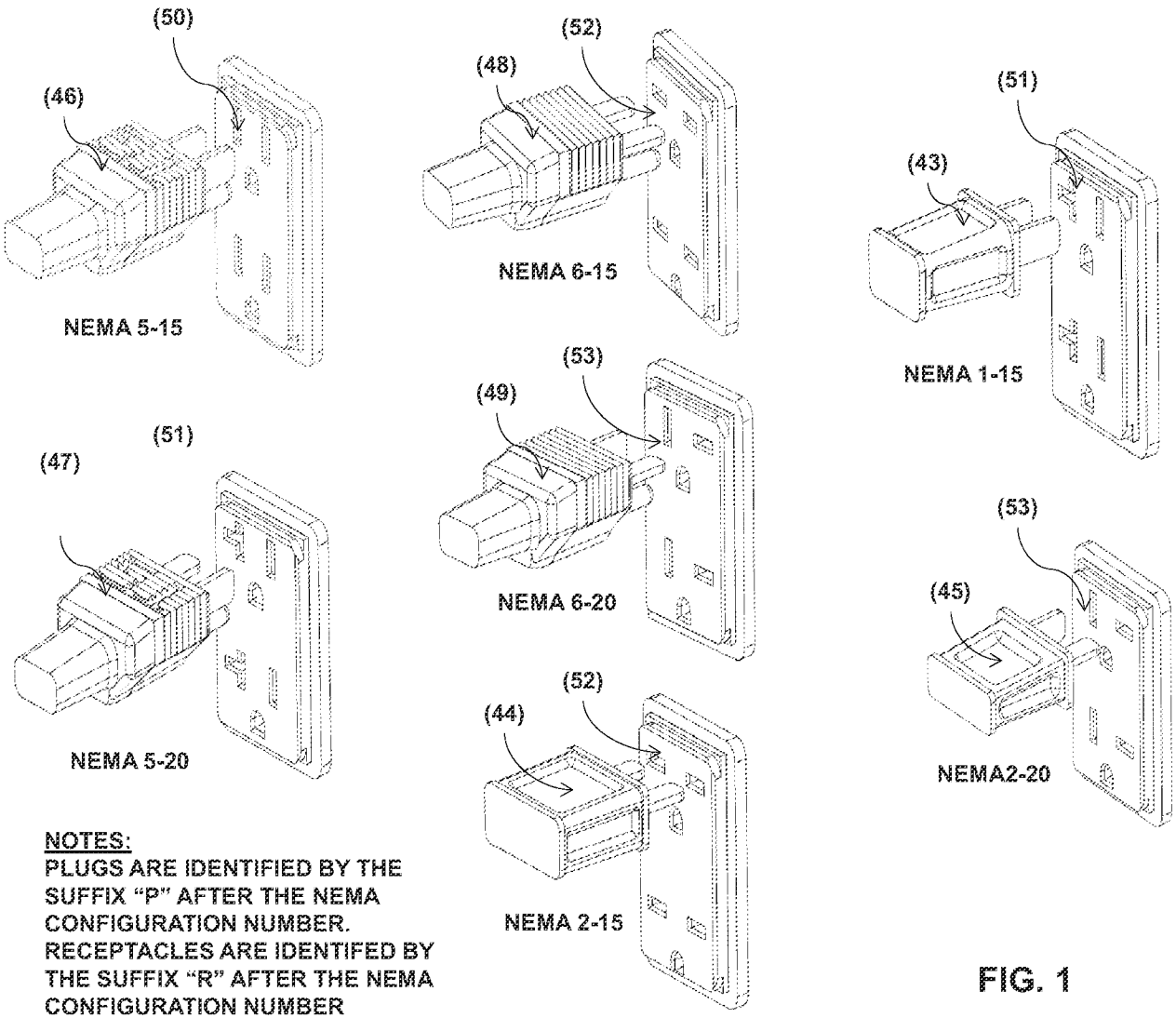

FIG. 1 shows some of the most common NEMA outlets with matching plug configurations, with and without ground, which the present invention could be used with. The typical NEMA 1-15P 43 plug configuration employs two blades with the same geometry, or two blades of different width to distinguish line and neutral connections, in similar orientation with the body of the plug. The other configurations are for circuits with ground connections, also referred to as "grounded circuits", or "grounded plugs", or "grounded receptacles". This includes NEMA 5-15P 46, 5-20P 47, 6-15P 48 and 6-20P 49, all of which are with a ground pin and uses blades of the same geometry but in different orientation to the body of the plug. The NEMA 1-15P 43, 2-15P 44 and 2-20P 45 plugs could only be used with grounded outlet configurations when the ground pin lockout release mechanism 34 of the present invention is disabled.

Figure 2:
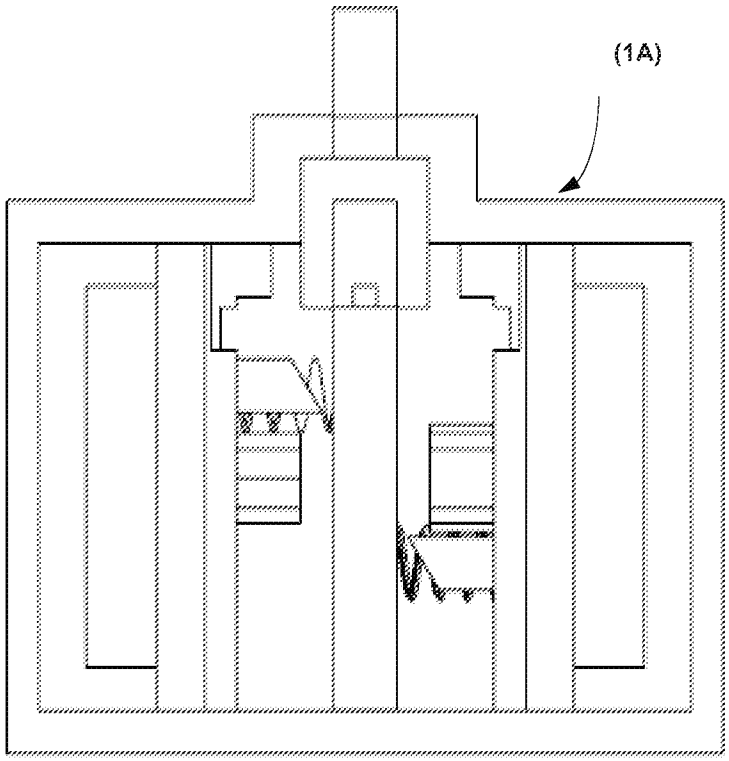
FIG. 2 shows the present invention using frame 1A for NEMA 1-15R and 5-15R 50 outlet configurations with the ground pin lockout release mechanism 34 enabled. In the figure, the outlet 51 is a combination NEMA 5-15R and 5-20R and could be used with either plug configuration NEMA 5-15P or 5-20P. A NEMA 1-15P plug may be used on either outlet 50 or 51.

FIG. 2 shows the present invention as designed for outlets of similar configuration as the NEMA 1-15R and NEMA 5-15R 50 with the ground pin lockout release mechanism 34 enabled. When used for these outlet configurations only, a version of the tamper-resistant shutter device could use a short frame 1A with the main shutter sub-assembly 100 and the ground pin lockout release mechanism 34.

While the device is in a "shutter close", or "default" position, or when no plug is inserted, the main shutter sub-assembly 100 and the ground pin lockout release mechanism 34 are in the following state:

1. Main shutter sub-assembly 100:
   a) The wedge-driven positioning members 7A and 7B are biased by springs 14A and 14B away from each other where the holes 2C and 2D on frame 1A are covered,
   b) The stopper plates 22A and 22B are locked with each other,
   c) The wedge-shaped pins 12A and 12B are out of the slider openings 19 and 20,
   d) The bottom portion of 7A and 7B are covering slots 2C and 2D of frame 1A.
2. Ground pin lockout release mechanism 34:
   a) The wedge-driven positioning member 34 is biased outside frame 1A by spring 25 secured between the holder 42 and the stopper plate 22A through the retaining pin 23,
   b) The sloped surface 39 of the wedge-driven positioning member 34 is positioned within the ground pin inlet opening on the outlet cover,
   c) The stoppers 41A and 41B are lined up with the stoppers 13A and 13B on the wedge-driven positioning members 7A and 7B.

Figure 3:
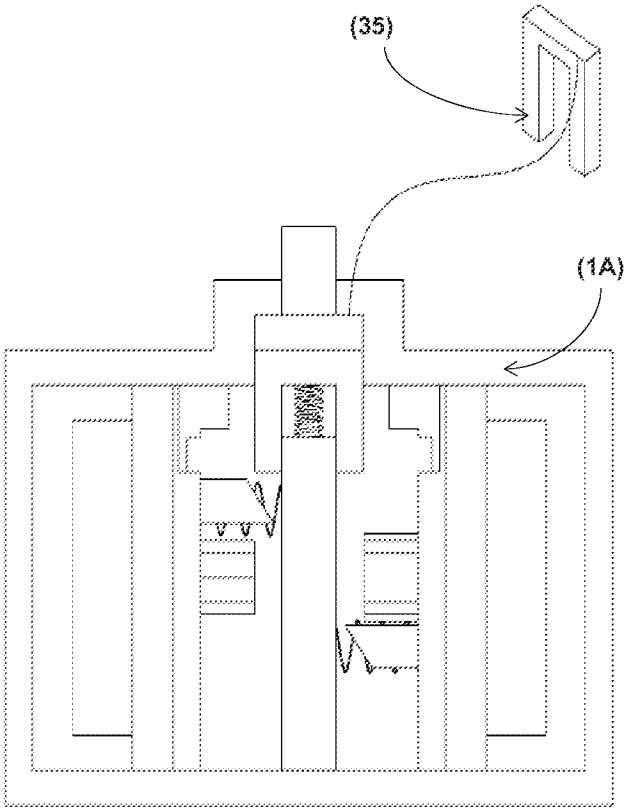
FIG. 3 shows the present invention using frame 1A for NEMA 1-15R and 5-15R 50 outlet configurations with the ground pin lockout release mechanism 34 disabled. In this mode, the lockout insert 35 is applied to restrict movement of the ground pin lockout release mechanism 34.

FIG. 3 shows the present invention used with outlet configurations NEMA 1-15R and NEMA 5-15R 50 with the ground pin lockout release mechanism 34 disabled. For these outlet configurations, a variation of the tamper-resistant shutter device uses frame 1A with the main shutter sub-assembly 100 and the ground pin lockout release mechanism 34.

Figure 4:
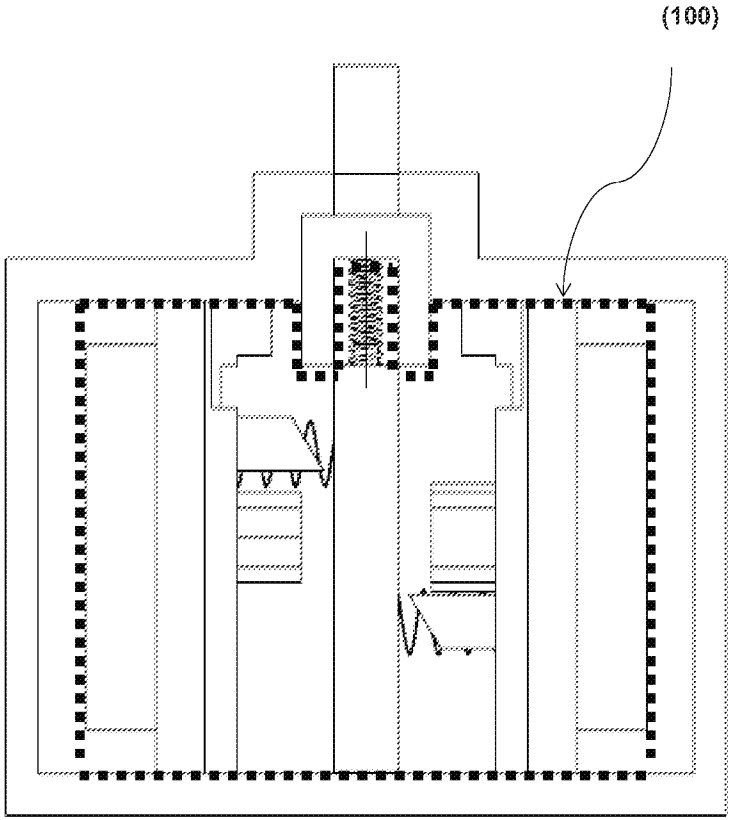
FIG. 4 shows the layout of the main shutter sub-assembly 100 of the present invention using frame 1A.

FIG. 4 shows the main shutter sub-assembly 100 layout using frame 1A. Some parts of the main shutter sub-assembly 100 may be made integral to the frame 1A.

Figure 5:
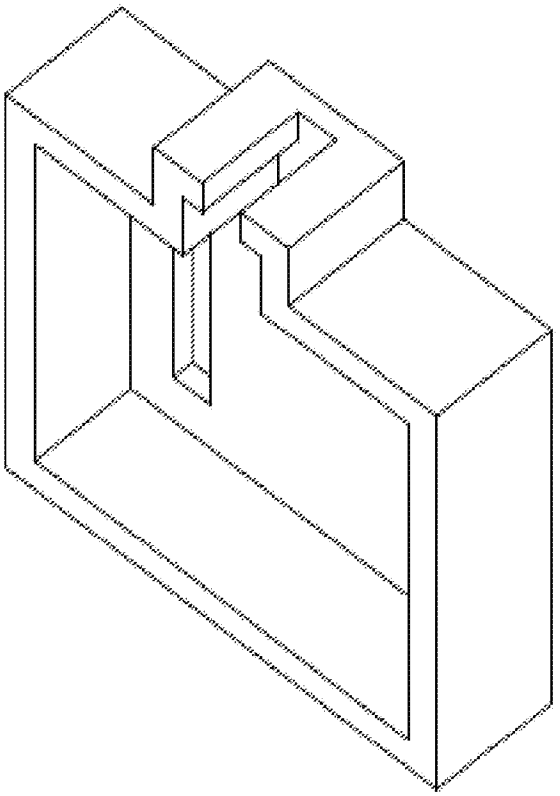
FIG. 5 shows the frame (1A) of the present invention for NEMA 1-15R and 5-15R 50 outlet configurations.
Figure 5:
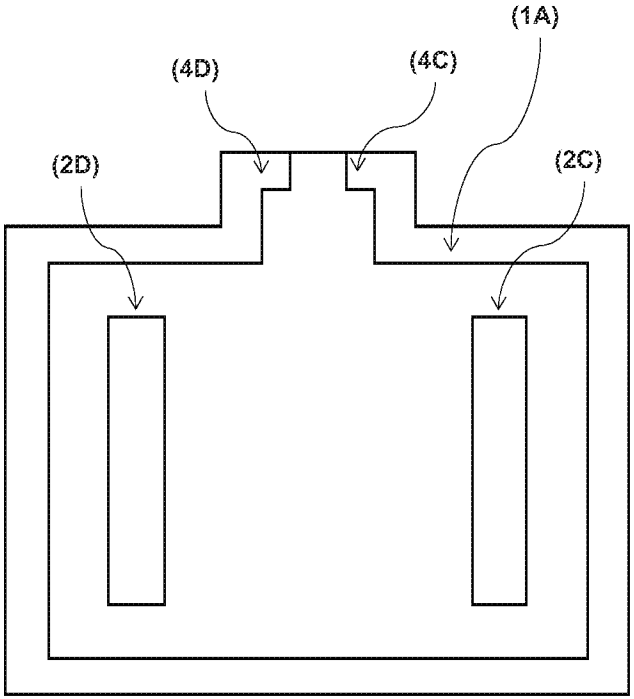

FIG. 5 shows the frame 1A of the present invention used with outlet configurations NEMA 1-15P 51 and 5-15R 50 plugs. Since these plug configurations have their blades in the same orientation, it is not necessary to have the secondary shutter sub-assembly 200 and therefore possible to use a shorter frame 1A.

Figure 6:
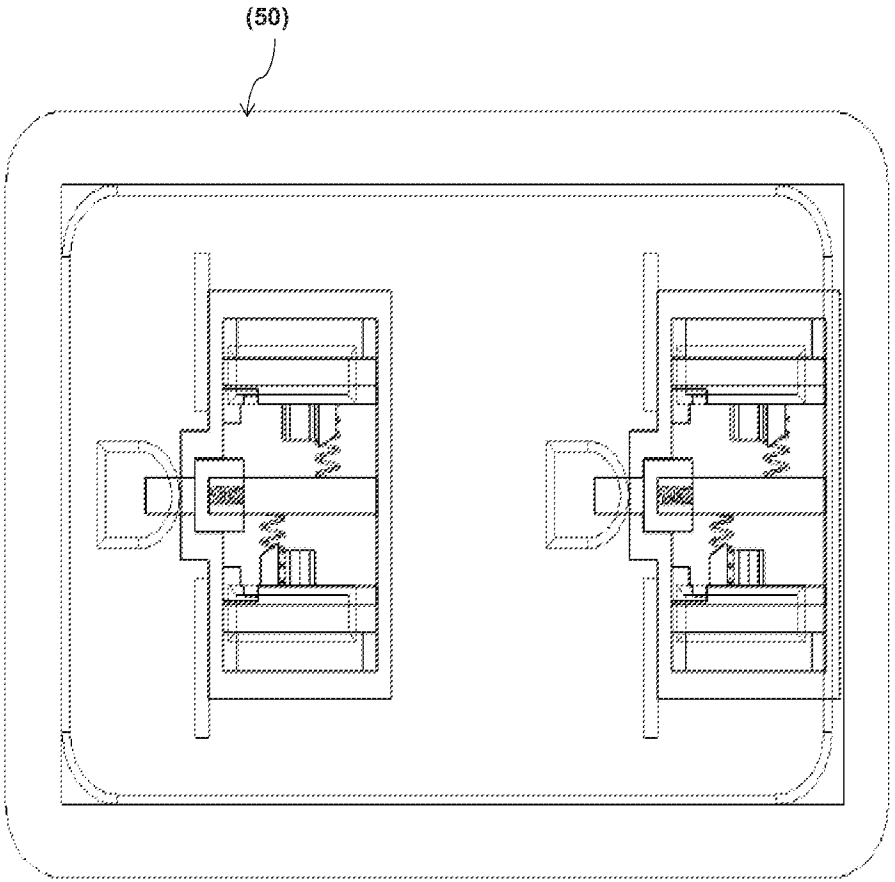
FIG. 6 shows an open view of the present invention using frame 1A incorporated into a receptacle outlet housing cover for NEMA 1-15R and 5-15R 50 configurations.

FIG. 6 shows an open view of the present invention with frame 1A incorporated into a receptacle outlet housing cover for use with NEMA 1-15P 43 and 5-15P 46 plugs.

Figure 7:
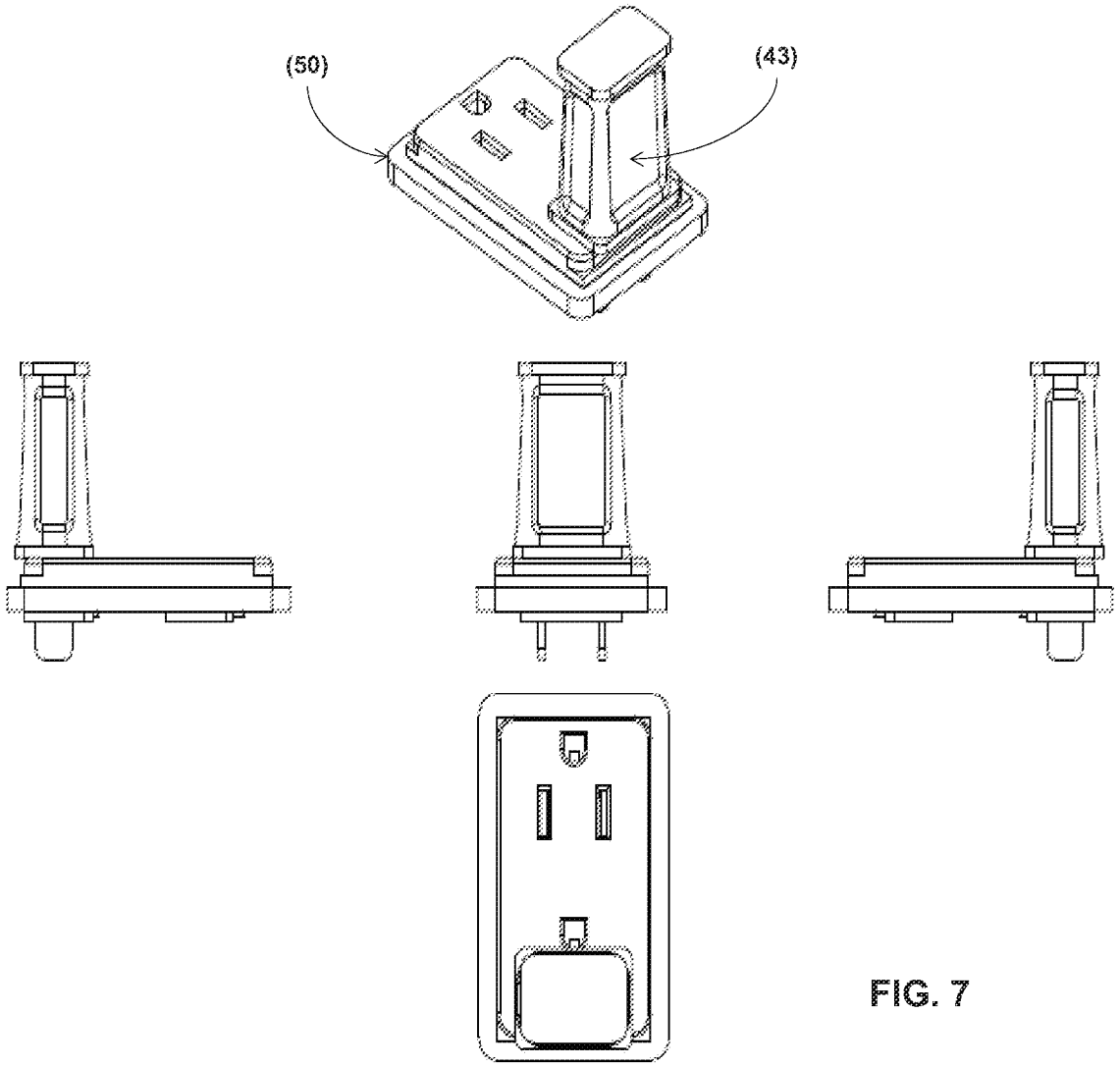
FIG. 7 shows multiple views of the present invention using frame 1A incorporated into a receptacle outlet housing cover used with a NEMA 1-15P 43 plug.

FIG. 7 shows multiple views of the present invention with frame 1A incorporated into a receptacle outlet cover and used with a NEMA 1-15P 43 plug.

When a plug such as NEMA 1-15P is used with the outlet with the ground pin lockout release mechanism 34 disabled, the following movements occur subsequently on the main shutter sub-assembly 100:

a) The plug blades initially make contact with the wedge-driven positioning members 7A and 7B,
b) The blades are pushed in through the slopes 9A and 9B, gradually causing 7A and 7B to move inward and towards each other,
c) The wedge-shaped pins 12A and 12B move inward and push the stopper plates 22A and 22B sideward and away from each other, fully opening the hole 21,
d) The pin 11A and its mating part 11B engage with each other through the hole 21,
e) The wedge-driven positioning members 7A and 7B reach their maximum displacement defined by half the distance between the plug blades,
f) The hole sections 2A and 2B on the shutter frame 1 open to allow the plug blades to be used with the electrical outlet,
g) The ground pin lockout release mechanism 34 remains in its default "shutter close" position.

Pulling out a plug such as a NEMA 1-15P from the outlet with the ground pin lockout release mechanism 34 disabled, causes the main shutter sub-assembly 100 to return to its "default" or "shutter close" position by reversing the sequence outlined above.

Figure 8:
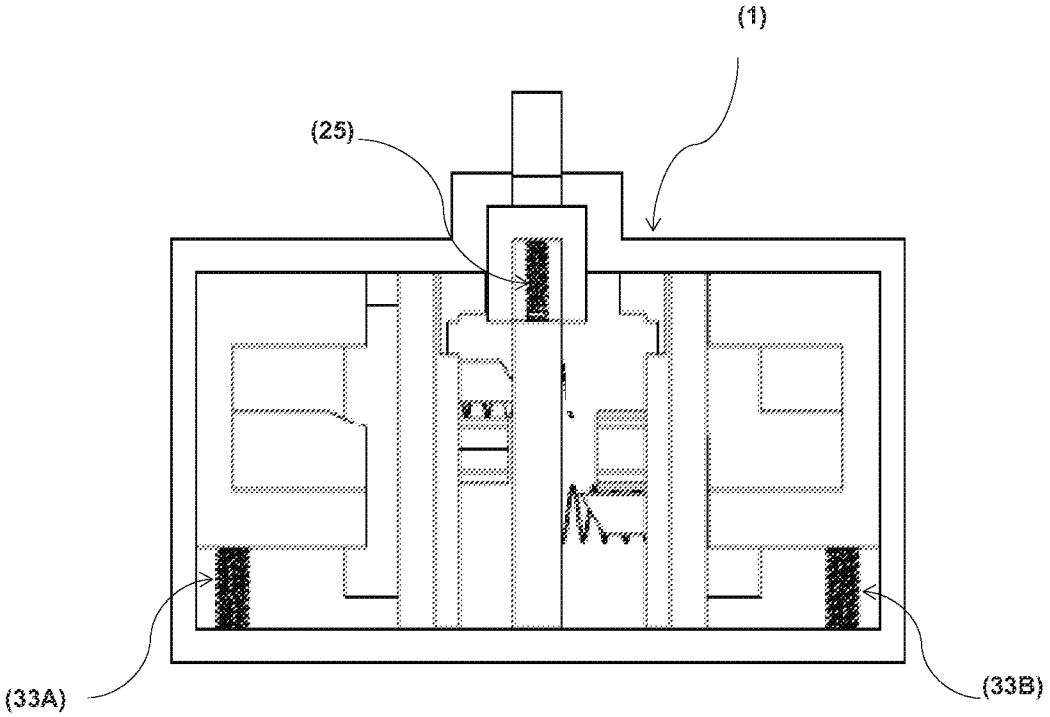
FIG. 8 shows the present invention using frame 1 for electrical outlet configurations NEMA 1-15R, 2-15R, 2-20R, 5-15R 50, 5-20R 51, 6-15R 52 and 6-20R 53 with the ground pin lockout release mechanism 34 enabled.

FIG. 8 shows the present invention with frame 1 used with electrical outlet configurations NEMA 1-15R, 2-15R, 2-20R, 5-15R 50, 5-20R 51, 6-15R 52 and 6-20R 53 with the ground pin lockout release mechanism 34 enabled. To accommodate all these plug configurations, frame 1 is used with the present invention.

While the tamper-resistant shutter device is in a "shutter close", or "default" position, or when no plug is inserted, the main shutter sub-assembly 100, secondary shutter sub-assembly 200, and the ground pin lockout release mechanism 34 are in the following state:

1. Main shutter sub-assembly 100:
   a) The wedge-driven positioning members 7A and 7B are biased by spring 14 away from each other where the holes 2A, 2B, 3A and 3B on the frame 1 are covered,
   b) The stopper plates 22A and 22B are locked with each other,
   c) The tips of the wedge-shaped pins 12A and 12B are out of the slider openings 19 and 20,
   d) The slots 10A and 10B of the main wedge-driven positioning members 7A and 7B are locked with the stoppers 30C and 30D of the secondary shutter sub-assembly 200,
   e) The bottom portions of 7A and 7B are covering slots 2A and 2B of frame 1.
2. Secondary shutter sub-assembly 200:
   a) The wedge-driven positioning members 26A and 26B are biased towards one end of the frame by the springs 33A and 33B,
   b) The openings 27A and 27B are directly above a closed section of frame 1,
   c) The openings 3A and 3B are covered by the lower portion of the sloped surfaces 28A and 28B of the wedge-driven positioning members 26A and 26B,
   d) The stoppers 30C and 30D are locked by the slots 10A and 10B of the wedge-driven positioning members 7A and 7B of the main shutter sub-assembly 100,
   e) The lower portion of the sloped surface of the wedge-driven positioning members 7A and 7B of the main shutter sub-assembly 100 are tucked under sections 30A, 30B, 31A and 31B.

Figure 9:
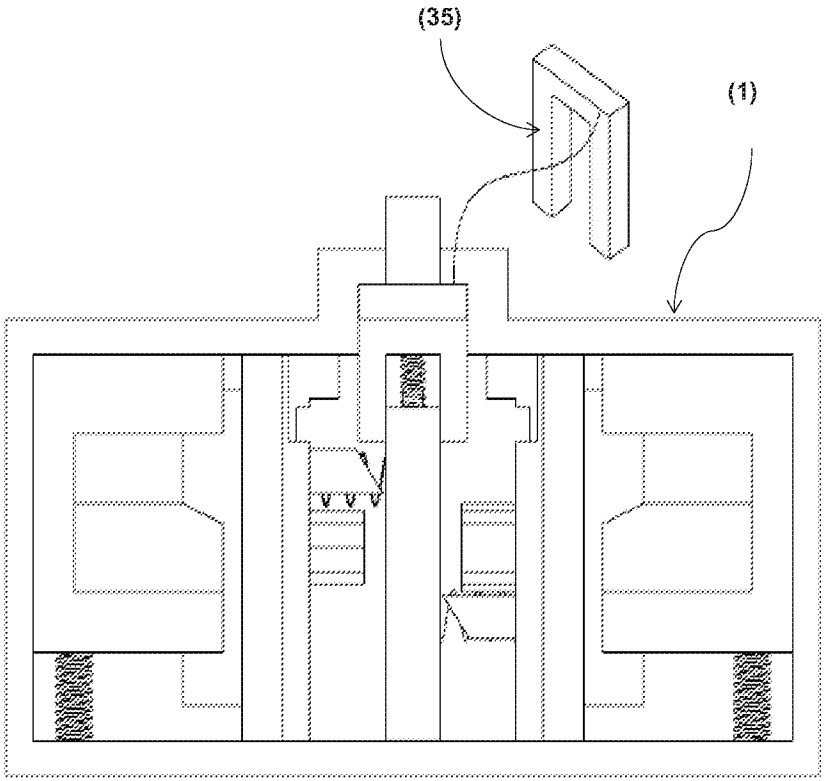
FIG. 9 shows the present invention using frame 1 for electrical outlet configurations NEMA 1-15R, 2-15R, 2-20R, 5-15R 50, 5-20R 51, 6-15R 52 and 6-20R 53 with the ground pin lockout release mechanism 34 disabled.

3. Ground pin lockout release mechanism 34:
   a) The wedge-driven positioning member 34 is biased outside the frame by spring 25 secured between the holder 42 and the stopper plate 22A through the retaining pin 23,
   b) The sloped surface 39 of the wedge-driven positioning member 34 is positioned within the ground pin inlet opening,
   c) The stoppers 41A and 41B are lined up with the stoppers 13A and 13B on the wedge-driven positioning members 7A and 7B, FIG. 9 shows the present invention with frame 1 used with electrical outlet configurations NEMA 1-15R, 2-15R, 2-20R, 5-15R 50, 5-20R 51, 6-15R 52 and 6-20R 53 with the ground pin lockout release mechanism 34 disabled. The lockout insert 35 is in place, restricting any movement of the ground pin lockout release mechanism 34.

Figure 10:
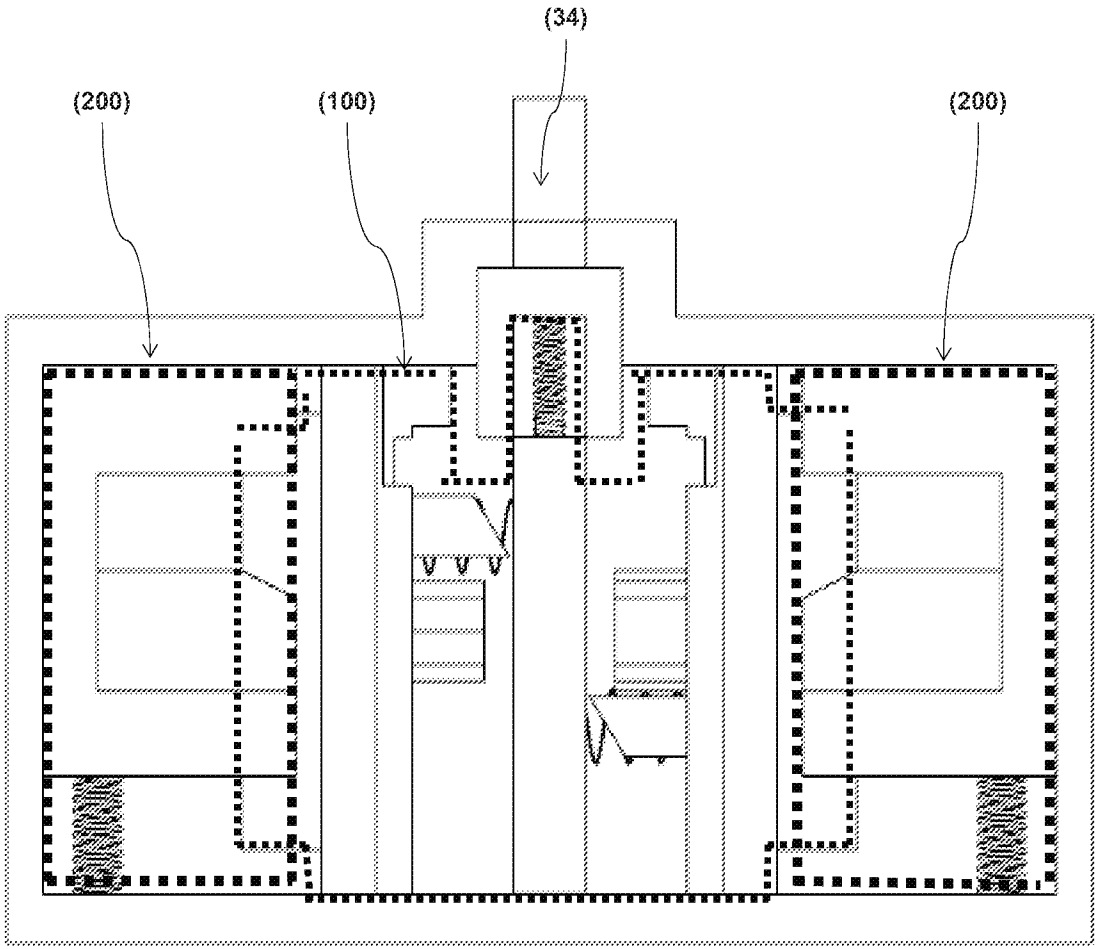
FIG. 10 shows a layout of the main shutter sub-assembly 100, the secondary shutter sub-assembly 200, and the ground pin lockout release mechanism 34 of the present invention using frame 1.

FIG. 10 shows the main shutter sub-assembly 100, the secondary shutter sub-assembly 200, and the ground pin lockout release mechanism 34 layout in the present invention using frame 1.

Figure 11:
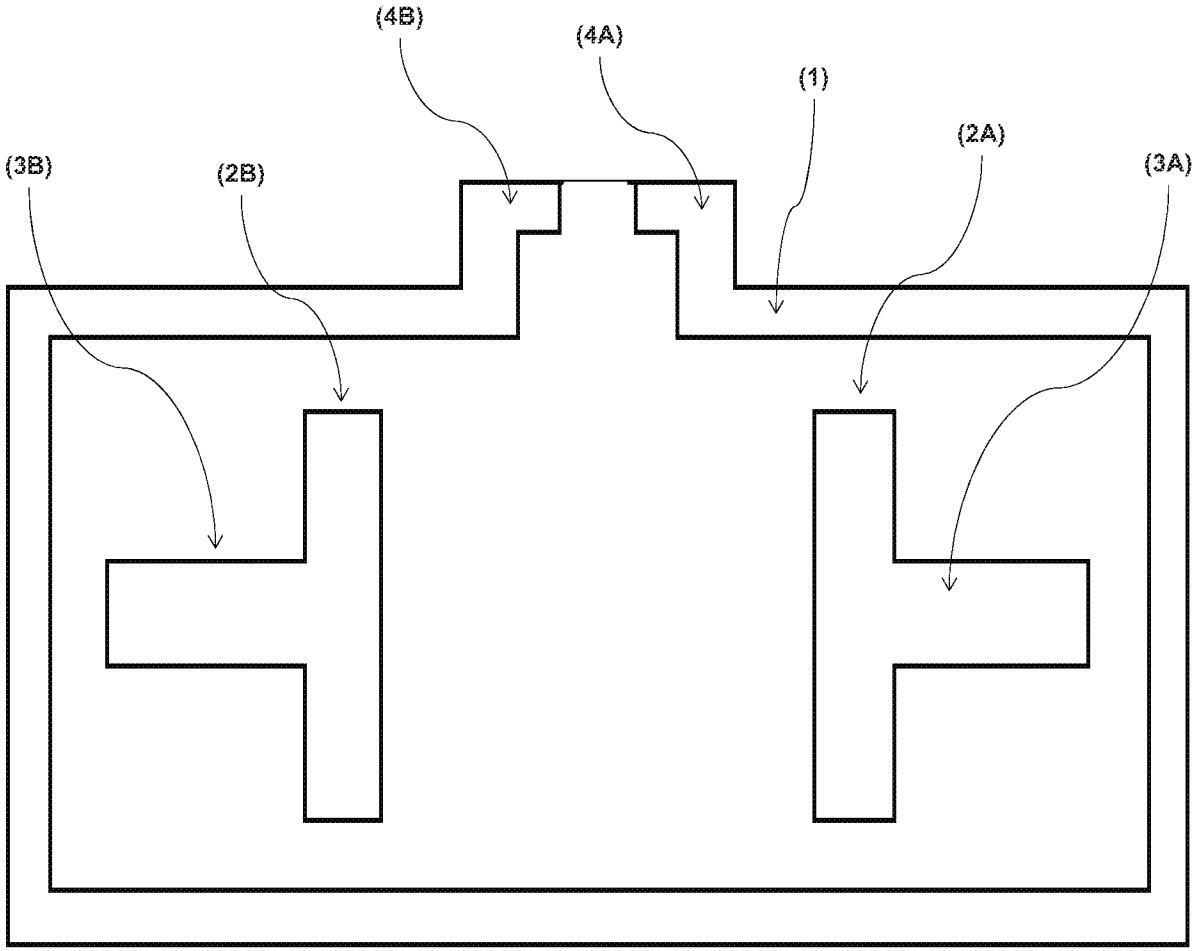
FIG. 11 shows the frame 1 of the present invention for electrical outlet configurations NEMA 1-15R, 2-15R, 2-20R, 5-15R 50, 5-20R 51, 6-15R 52 and 6-20R 53.
Figure 12:
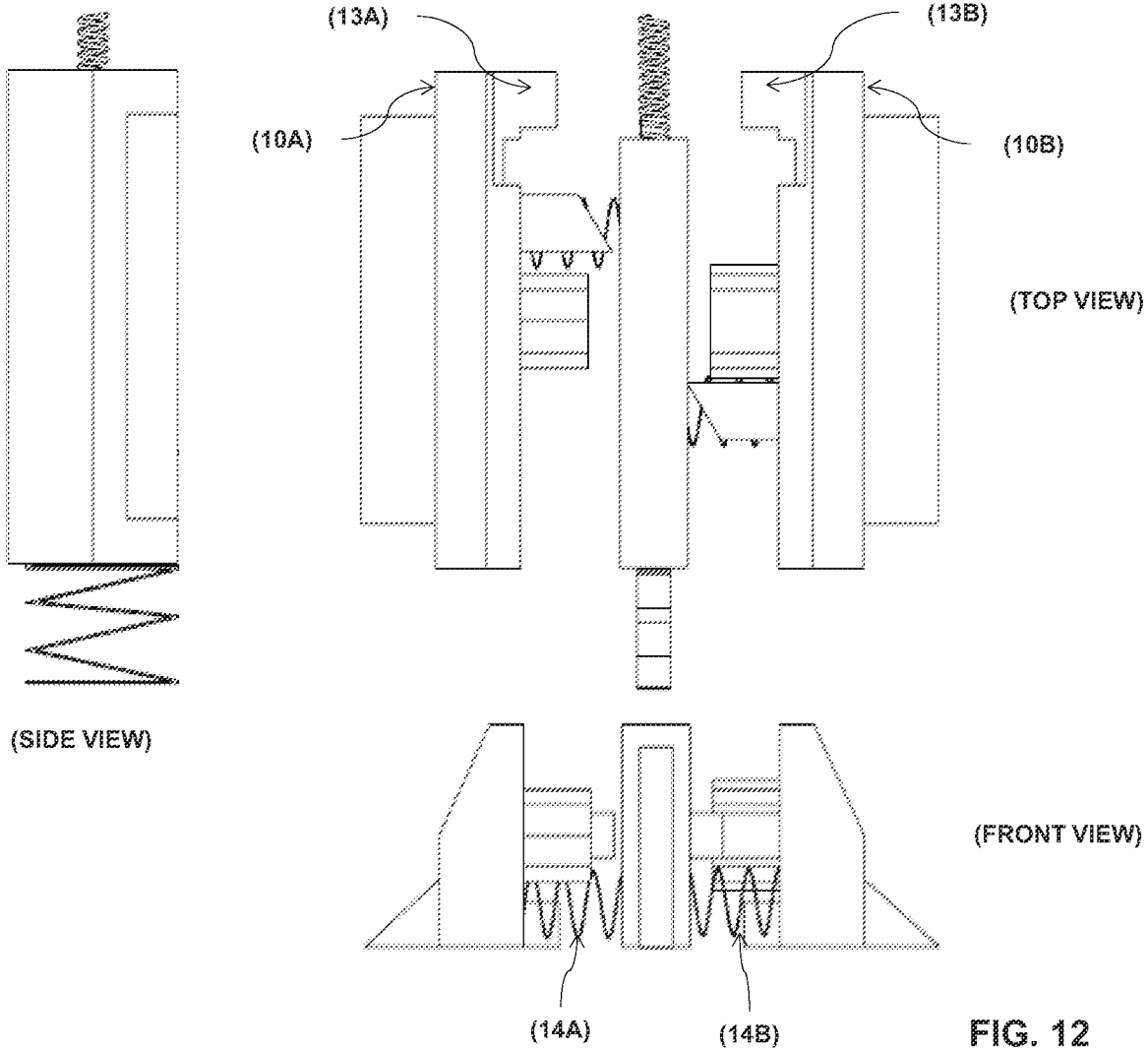
FIG. 12 shows multiple views of the main shutter sub-assembly 100 of the present invention.
Figure 13:
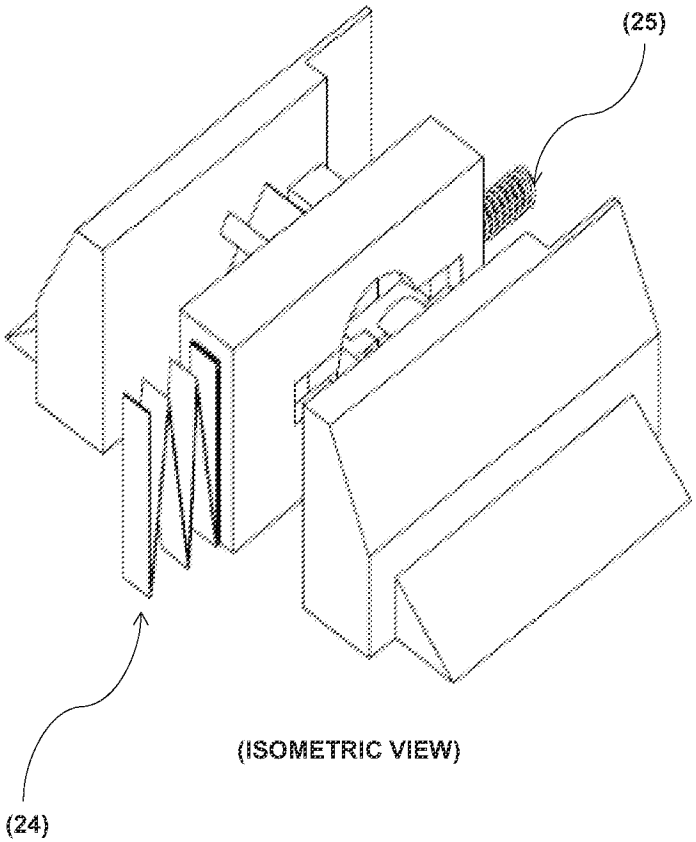
FIG. 13 shows the isometric view of the main shutter sub-assembly 100 of the present invention.
Figure 14:
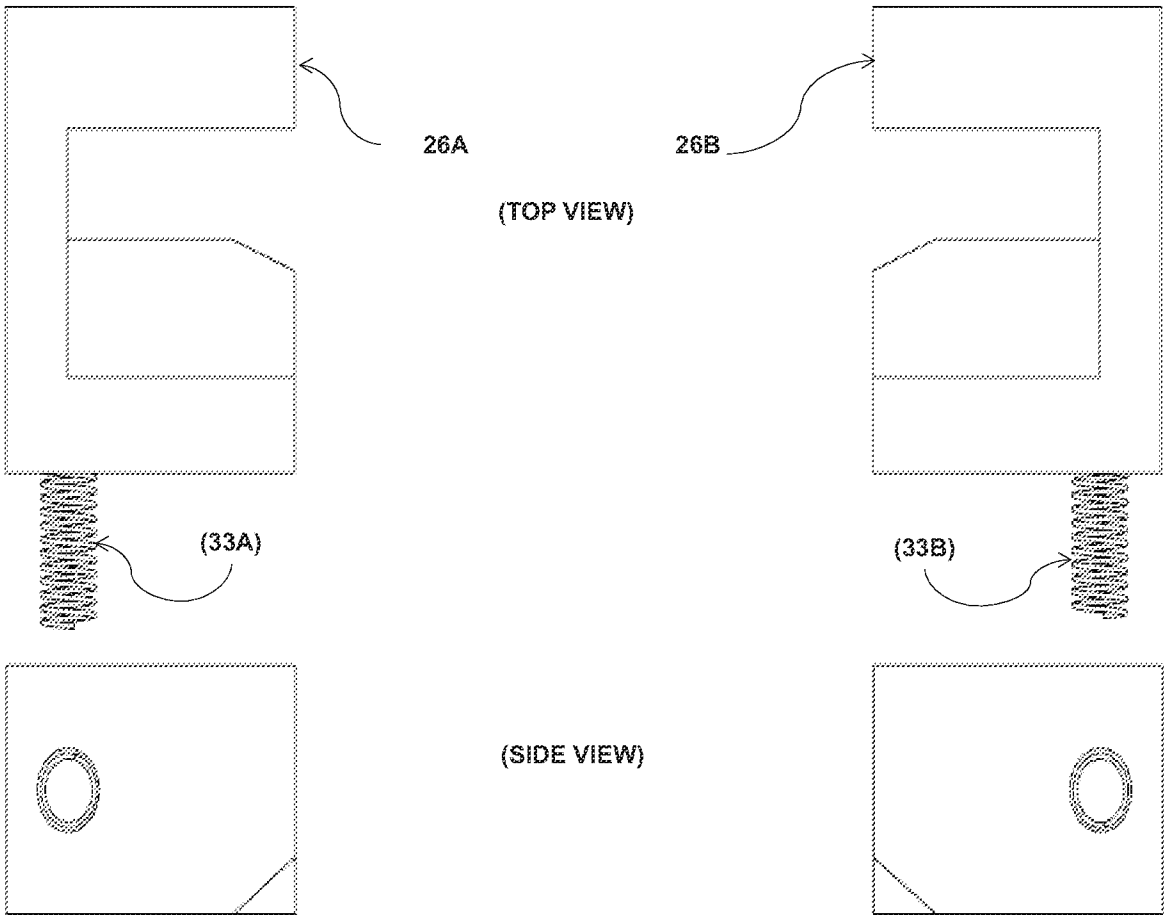
FIG. 14 shows multiple views of the secondary shutter sub-assembly 200 of the present invention.
Figure 15:
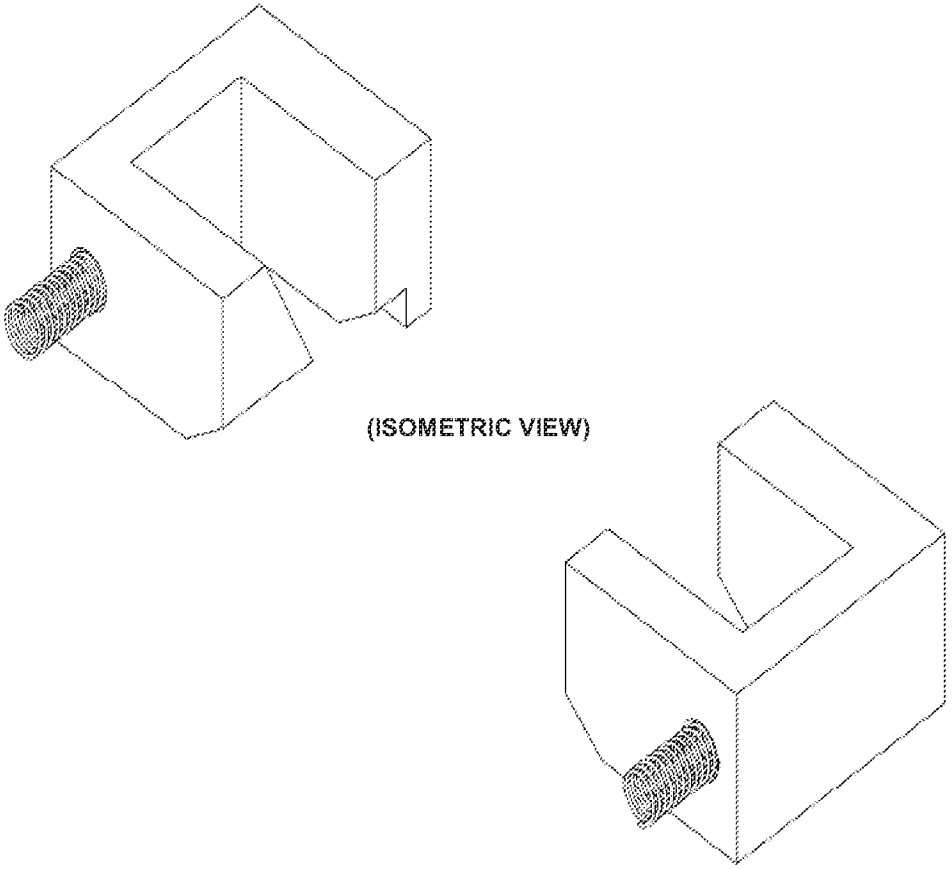
FIG. 15 shows the isometric view of the secondary shutter sub-assembly 200 of the present invention.

FIG. 11 shows the frame 1 of the present invention used with electrical outlet configurations NEMA 1-15R, 2-15R, 2-20R, 5-15R 50, 5-20R 51, 6-15R 52 and 6-20R 53.

FIGS. 12 to 15 shows different views of the main shutter sub-assembly 100 and the secondary shutter sub-assembly 200 as used in the present invention.

Figure 16:
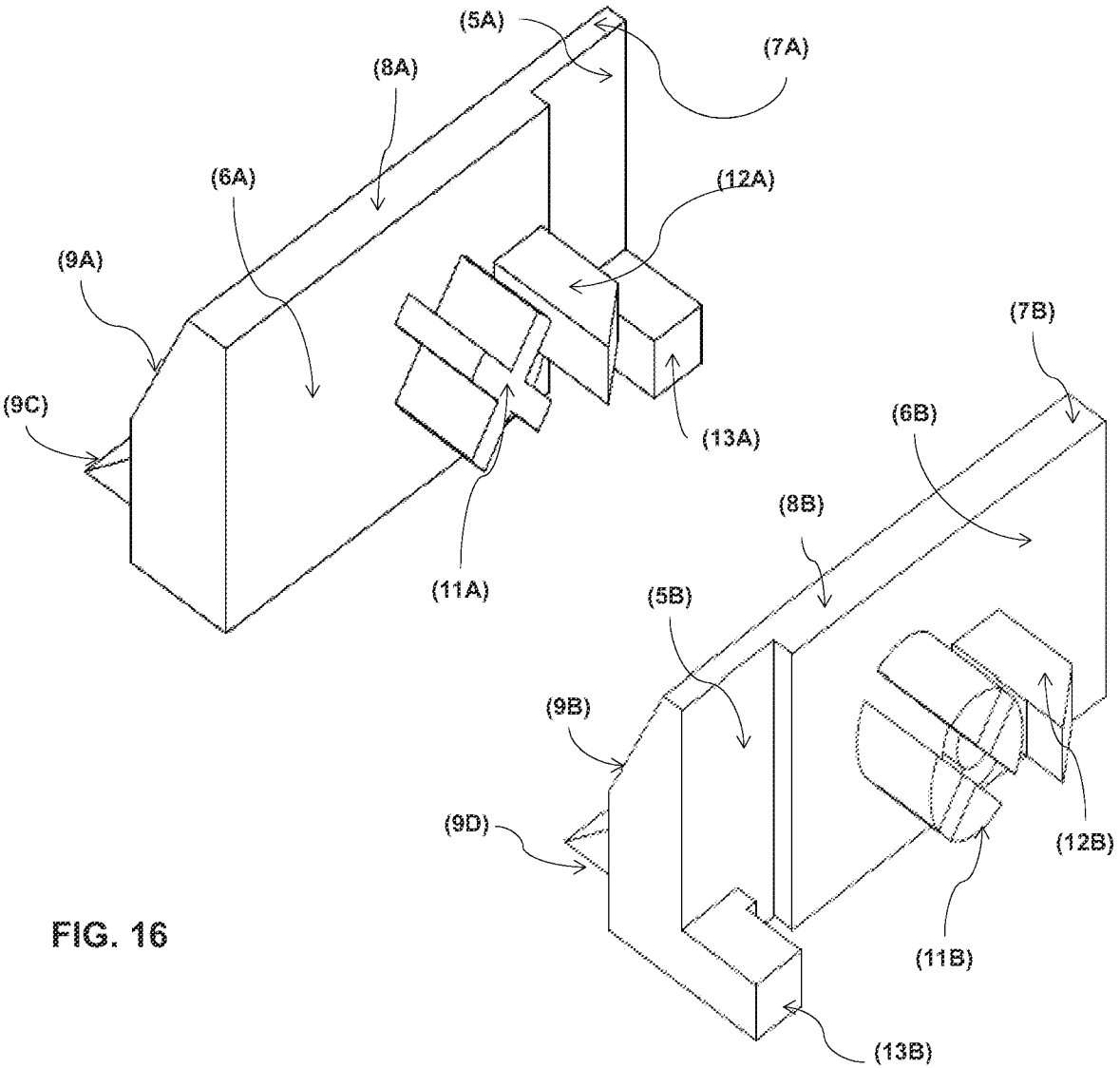
FIG. 16 shows the wedge-driven positioning members 7A and 7B of the main shutter sub-assembly 100 used in the present invention.
Figure 17:
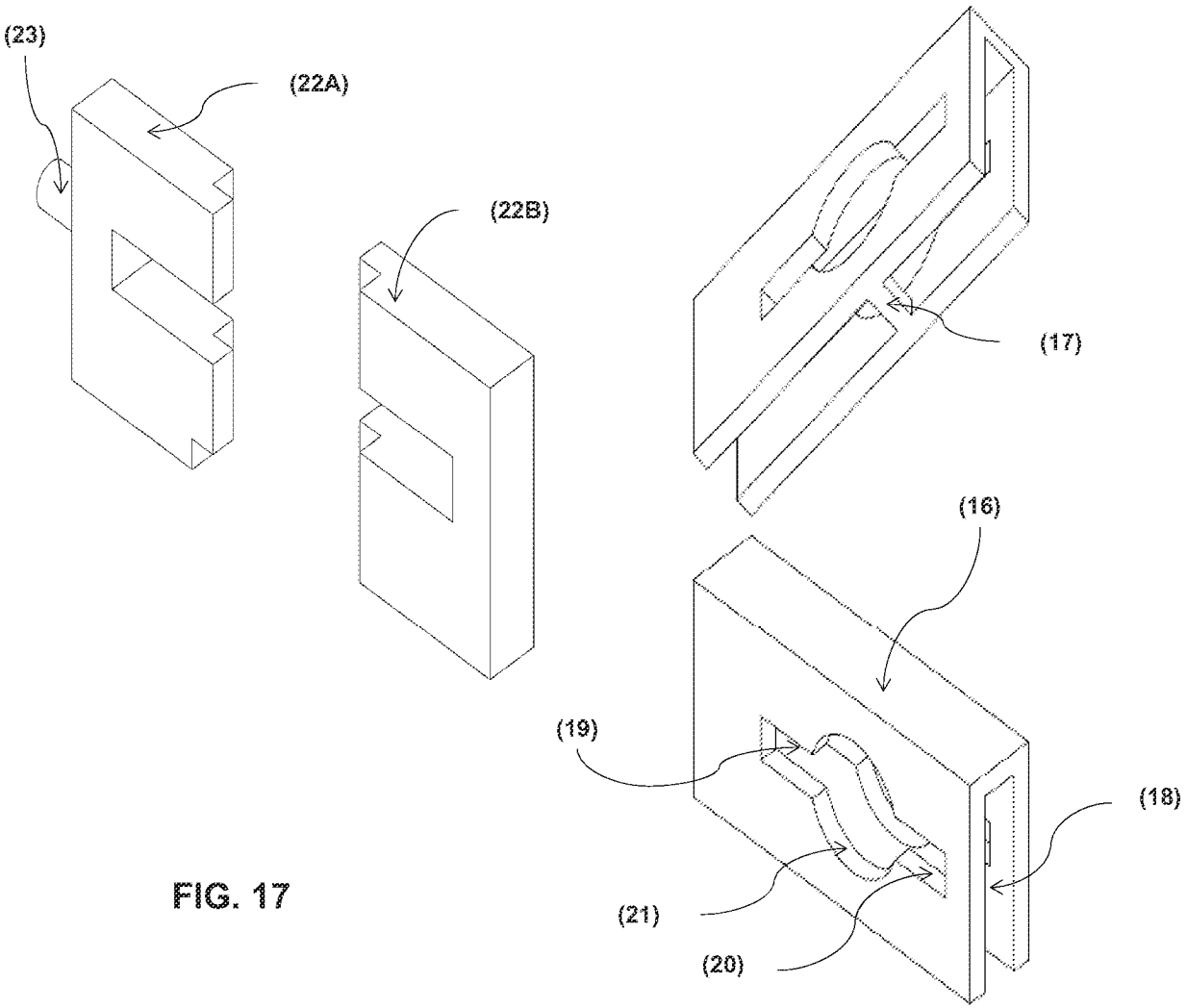
FIG. 17 shows the locking mechanism 16 of the main shutter sub-assembly 100 used in the present invention.

FIGS. 16 and 17 shows the main and secondary wedge-driven positioning members 7A, 7B, 26A and 26B used in the present invention.

Figure 18:
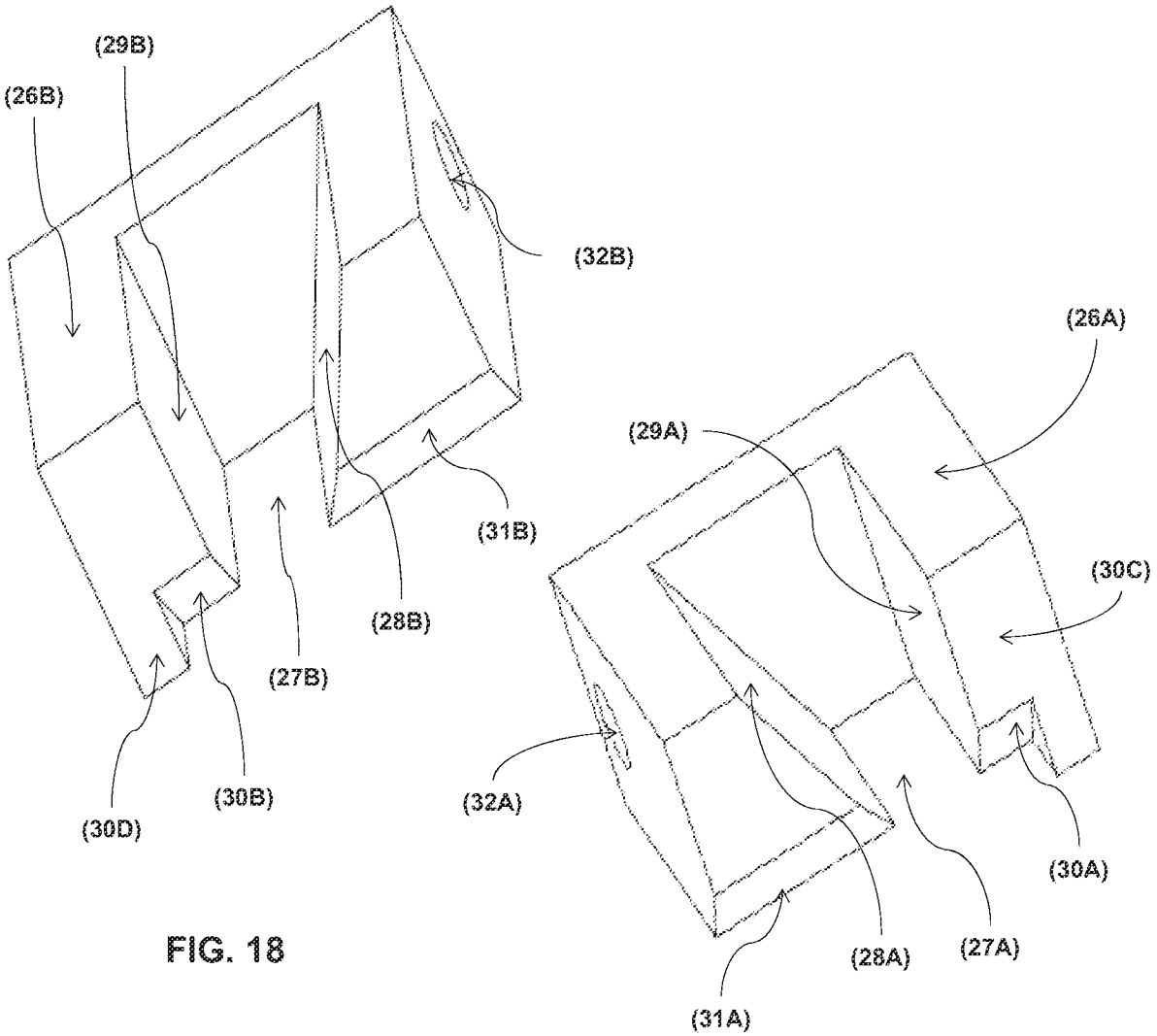
FIG. 18 shows the secondary shutter sub-assembly 200 wedge-driven positioning members 26A and 26B used in the present invention.
Figure 19:
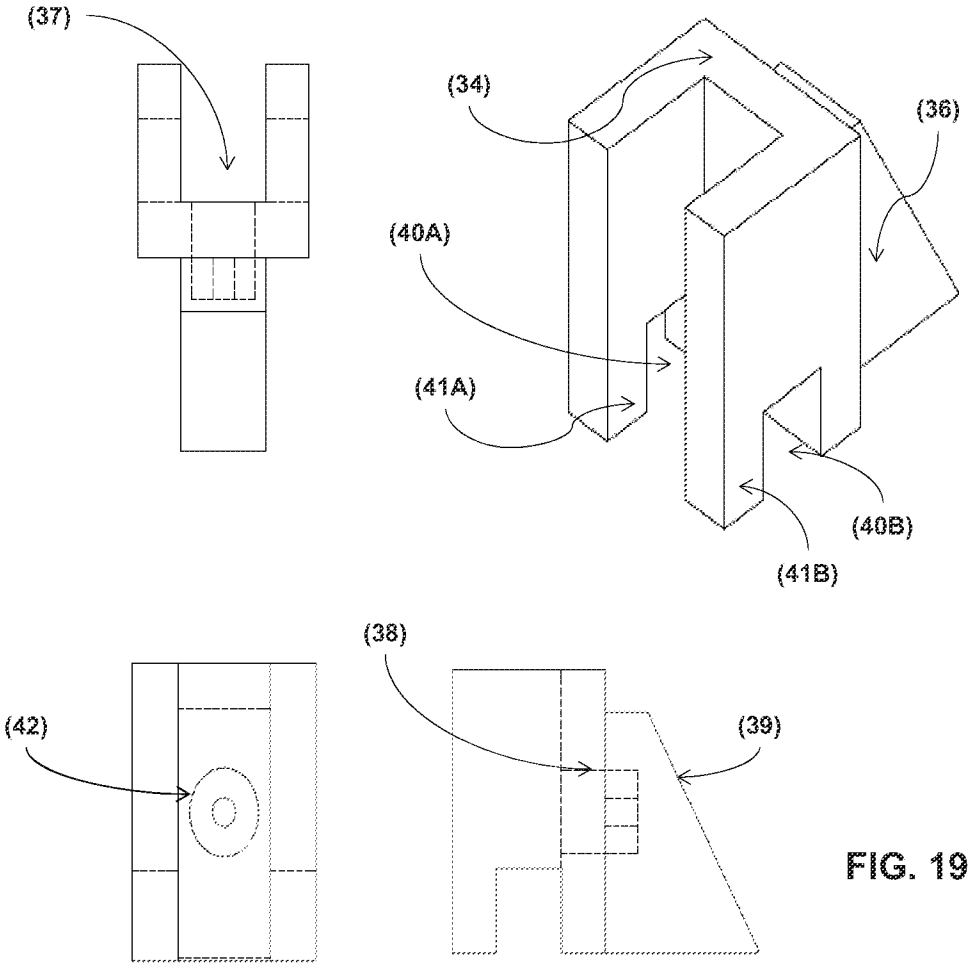
FIG. 19 shows multiple views of the ground pin lockout release mechanism 34 used in the present invention.

FIGS. 18 and 19 shows details of the secondary wedge-driven positioning members 26A and 26B and the ground pin lockout release mechanism 34 used in the present invention.

Figure 20:
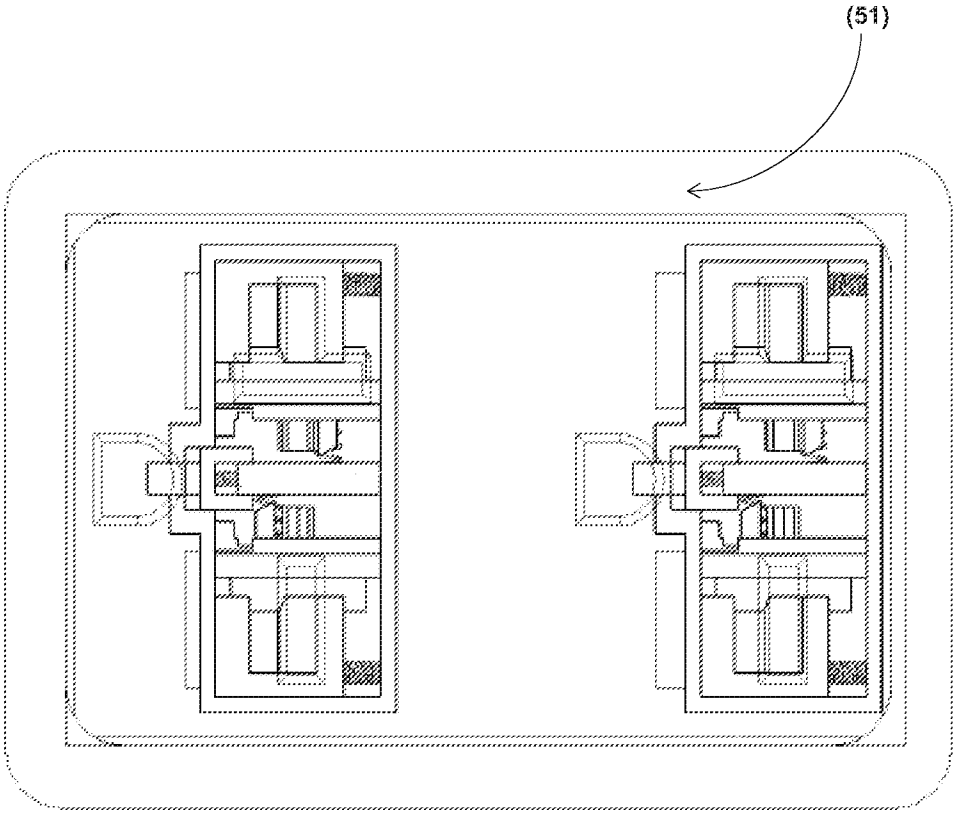
FIG. 20 shows an open view of the present invention with frame 1 incorporated into a receptacle outlet housing cover for NEMA configurations 1-15R 51, 2-15R 52, 2-20R 53, 5-15R 50, 5-20R 51, 6-15R 52 and 6-20R 53 plugs.

FIG. 20 shows an open view of the present invention with frame 1 incorporated into a receptacle outlet housing cover for NEMA 1-15R, 2-15R, 2-20R, 5-15R 50, 5-20R 51, 6-15R 52 and 6-20R 53.

Figure 21:
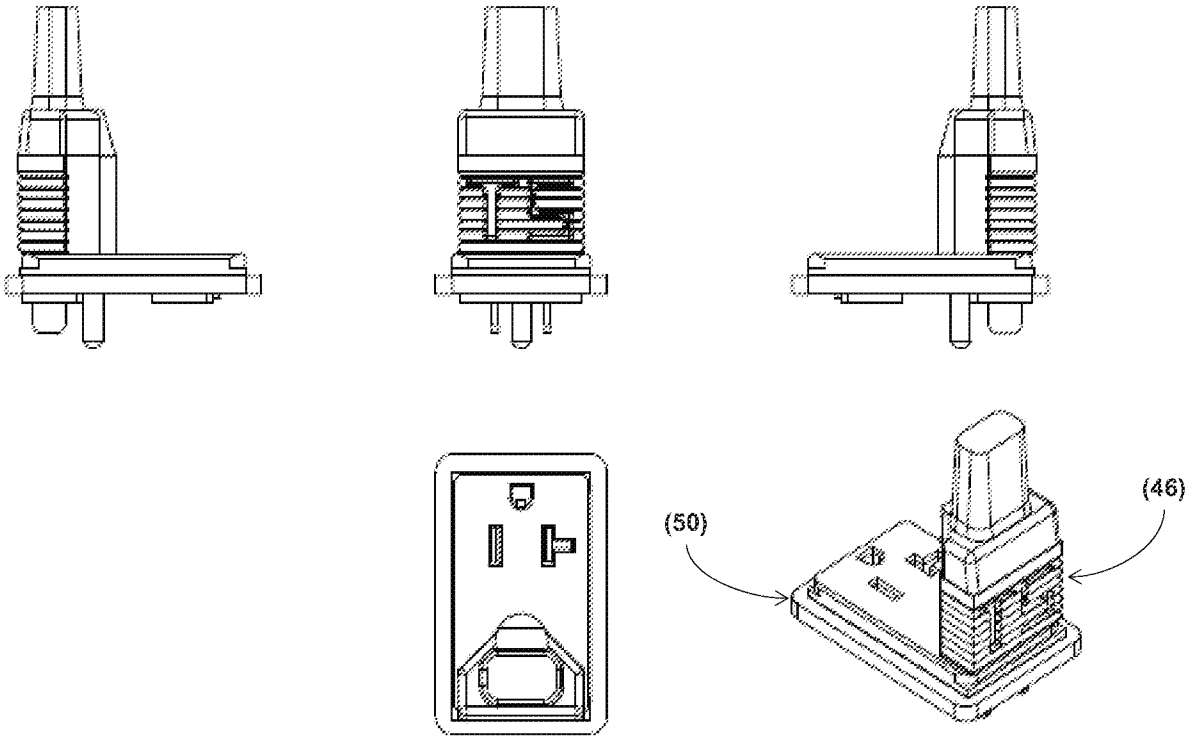
FIG. 21 shows multiple views of the present invention with frame 1 incorporated into a receptacle outlet cover and used with a NEMA 5-15P 46 plug.

FIG. 21 shows multiple views of the present invention with frame 1 incorporated into a receptacle outlet cover with a NEMA 5-15P 46 plug.

When a plug is used on outlet configuration NEMA 2-15R, 2-20R, 5-15R 50, 5-20R 51, 6-15R 52, or 6-20R 53 with the ground pin lockout release mechanism 34 disabled, the following movements occur subsequently on the main shutter sub-assembly 100 and the secondary shutter sub-assembly 200:

a) The plug blades initially make contact with the wedge-driven positioning members 7A and 7B,
   b) The blades are pushed in through the slopes 9A and 9B, gradually causing 7A and 7B to move inward and towards each other,
   c) The slots 10A and 10B of the wedge-driven positioning members 7A and 7B disengages with the stoppers 30C and 30D,
   d) The plug blades are pushed in through the sloped surfaces 28A and 28B cause the sideward displacement of wedge-driven positioning members 26A and 28B,
   e) The wedge-shaped pins 12A and 12B move inward pushing the stopper plates 22A and 22B sideward and away from each other, fully opening the hole 21,
   f) The pin 11A and its mating part 11B engage with each other through the hole 21,
   g) The wedge-driven positioning members 7A and 7B reach their maximum displacement defined by half the distance between the plug blades,
   h) The slots 27A and 27B finally align with the openings 3A and 3B on frame 1,
   i) The hole sections 2A and 2B on the shutter frame 1 are finally uncovered,
   j) The plug blades get fully engaged with the electrical outlet.

Pulling out a plug such as NEMA 5-15P 46, 5-20P 47, 6-15R 48, or 6-20R 49 from the outlet in which the ground pin lockout release mechanism 34 is disabled, causes the main shutter sub-assembly 100 and the secondary shutter sub-assembly 200 to return to their default or "shutter close" positions by reversing the sequence outlined above.

When a plug is used on outlet configurations NEMA 5-15R 50, 5-20R 51, 6-15R 52 and 6-20R 53 with the ground pin lockout release mechanism 34 enabled, the following movements occur subsequently on the main shutter sub-assembly 100, secondary shutter sub-assembly 200, and the ground pin lockout release mechanism 34:

a) The ground pin pushes the wedge-driven positioning member 34 to a defined position,
   b) The stoppers 41A and 41B move in so that openings 40A and 40B line up with the stoppers 13A and 13B on the wedge-driven positioning members 7A and 7B, allowing them free movement,
   c) The plug blades make contact with the wedge-driven positioning members 7A and 7B,
   d) The blades are pushed in through the slopes 9A and 9B, gradually causing 7A and 7B to move inward and towards each other,
   e) The slots 10A and 10B of the wedge-driven positioning members 7A and 7B disengage from the stoppers 30C and 30D,
   f) The plug blades being pushed in through the sloped surfaces 28A and 28B cause the sideward displacement of wedge-driven positioning members 26A and 26B,
   g) The wedge-shaped pins 12A and 12B move inward and push the stopper plates 22A and 22B sideward and away from each other, fully opening the hole 21,
   h) The pin 11A and its mating part 11B engage through the hole 21,
   i) The wedge-driven positioning members 7A and 7B reach their maximum displacement defined by half the distance between the plug blades,
   j) The slots 27A and 27B finally align with the openings 3A and 3B on frame 1,
   k) The hole sections 2A and 2B on the shutter frame 1 are finally uncovered,
   l) The plug blades get fully engaged with the electrical outlet.

Pulling out a plug such as NEMA 5-15P 46, 5-20P 47, 6-15P 48, or 6-20R 49 from the outlet with the ground pin lockout release mechanism 34 enabled causes the main shutter sub-assembly 100, secondary shutter sub-assembly 200, and the ground pin lockout release mechanism 34 to return to their default or "shutter close" positions by reversing the sequence outlined above.

What is claimed is:

1. A framed tamper-resistant shutter device incorporated as an accessory to the housing or cover of electrical receptacle outlets including Arc Fault Circuit Interrupters (AFCI) and Ground Fault Circuit Interrupters (GFCI) to prevent the insertion of any object other than an electrical plug of matching configuration, said framed tamper-resistant shutter device comprising:

an open frame, a main shutter sub-assembly, a secondary shutter sub-assembly, a ground pin lockout release mechanism, a set of wedge-driven positioning members that cause inward horizontal movement with defined displacements when a plug is used with the electrical outlet, the default position of the wedge-driven positioning members being "shutter close" when no plug is used with the outlet, a set of springs which biases the wedge-driven positioning members away from each other in a "shutter close" default position when no plug is used with the outlet, with the same springs providing resistance between the wedge-driven positioning members and the blades when a plug is inserted, a set of pins and a mating part on the opposing wedge-driven positioning members, engaging when moved as a plug is used with the outlet, a set of wedge-shaped pins on each of the wedge-driven positioning members which push the spring-biased stopper plates sideways to open a hole and allow engagement of the pin with its mating part when a plug is used with the outlet, a set of stopper plates biased to the middle position by springs serving as barrier between the pin and its mating part when no plug is used with the outlet, and a set of springs which bias the stopper plates to the middle position to restrict the engagement of the pin with its mating part when no plug is used with the outlet.

2. The secondary shutter sub-assembly and the main shutter sub-assembly of claim 1, said device being able to receive more than one type or geometric configuration of electrical plugs, both with and without ground, regardless of the orientation of any of said plug blades and covering all standard 120V and 240V plug configurations.

3. The secondary shutter sub-assembly of claim 1 further comprising a set of wedge-driven positioning members that causes sideward movement to open a portion of the shutter when a plug of the same configuration as the outlet is inserted, a set of openings which match a portion of the plug blades complimenting the other part on the wedge-driven positioning members to allow insertion of a plug of the same configuration as the electrical outlet, a set of springs of such size and shape so as to bias the secondary shutter sub-assembly to a shutter close default position when no plug is used with the electrical outlet, a set of slots that line up with a stopper in the wedge-driven positioning members of to restrict movement of the sub-assembly unless a plug of the same configuration is used with the outlet; and a set of guide rails to ensure the sub-assembly's consistent planar movement with the frame when a plug is inserted or pulled out of the electrical outlet.

4. The ground pin lockout release mechanism of claim 1 further being configured and integrated within the framed tamper-resistant shutter device to prevent the device from accommodating any plug without a ground pin into the electrical outlet.

5. The ground pin lockout release mechanism of claim 1 further comprising a wedge-driven positioning member that causes displacement when a plug with ground is used with an electrical outlet, with the ground pin causing the initial displacement before any other members of the device, a set of slots which align with the stoppers on the wedge-driven positioning members when a plug with ground is used with an electrical outlet, a spring which biases the wedge-driven positioning member outside the frame, and a stopper which aligns with a stopper on the wedge-driven positioning members when no plug is used with the electrical outlet.

6. The framed tamper-resistant shutter apparatus of claim 1 wherein the open frame of said apparatus is a full version having the main shutter sub-assembly, the secondary shutter sub-assembly, and the ground pin lockout release mechanism used for plugs, both with and without a ground pin, and with plug blades not necessarily of the same orientation.

7. The framed tamper-resistant shutter apparatus of claim 1 wherein the open frame of said apparatus is a short version having the main shutter sub-assembly and the ground pin lockout release mechanism used for plugs, both with and without a ground pin, and where the blades are of the same orientation.

8. A method of preventing electrical outlets from being accessed by using foreign objects or any plug other than that of a matching configuration, with or without ground, said method employing a framed tamper-resistant shutter device which can be incorporated as an accessory to a housing or cover for an electrical receptacle outlet and including Arc Fault Circuit Interrupters (AFCI) and Ground Fault Circuit Interrupters (GFCI), said framed tamper-resistant receptacle method comprising the steps of:

having an open frame, having a main shutter sub-assembly, having a secondary shutter sub-assembly, having a ground pin lockout release mechanism, having a main shutter sub-assembly that has a set of two wedge-driven positioning members that causes inward horizontal movement with defined displacements when a plug is used with the electrical outlet, the default position of these wedge-driven positioning members is "shutter close" when no plug is used with the outlet, having a set of springs which biases the wedge-driven positioning members away from each other in a "shutter close" default position when no plug is used with the outlet—with the same springs providing resistance between the wedge-driven positioning members and the blades when a plug is inserted, having a pin and a mating part on the opposing wedge-driven positioning members, engaging when moved as a plug is used with the outlet, having a set of wedge-shaped pins on each of the wedge-driven positioning members which push the spring-biased stopper plates sideways to open a hole and allow engagement of the pin with its mating part when a plug is used with the outlet, having a set of stopper plates biased to the middle position by springs serving as barrier between the pin and its mating part when no plug is used with the outlet, and having a set of springs which bias the stopper plates to the middle position to restrict the engagement of the pin with its mating part when no plug is used with the outlet.

9. The method of claim 8 further being able to receive more than one type or configuration of electrical plugs, both with and without ground, covering all standard 120V and 240V plug configurations, regardless of the orientation of any of said plug blades when the secondary shutter sub-assembly is coupled with the main shutter sub-assembly.

10. Said method of claim 8 further comprising having a set of wedge-driven positioning members that causes sideward movement to open a portion of the shutter when a plug of the same configuration as the outlet is inserted, having a set of openings which match a portion of the plug blades complimenting the other part on the wedge-driven positioning members to allow insertion of a plug of the same configuration as the electrical outlet, having a set of springs of size and shape which bias the secondary shutter sub-assembly to a "shutter close" default position when no plug is used with the electrical outlet, having a set of slots that line up with a stopper in the wedge-driven positioning members to restrict movement of the sub-assembly unless a plug of the same configuration is used with the outlet, and having a set of guide rails to ensure the sub-assembly's consistent planar movement with the frame when a plug is inserted or pulled out of the electrical outlet.

11. The method of claim 8 further having the ground pin lockout release mechanism being configured and integrated within the framed tamper-resistant shutter device to prevent the device from accommodating any plug without a ground pin into the electrical outlet.

12. The method of claim 8 with the ground pin lockout release mechanism further comprising having a wedge-driven positioning member that causes displacement when a plug with ground is used with an electrical outlet, with the ground pin causing the initial displacement before any other members of the device, having a set of slots which align with the stoppers on the wedge-driven positioning members when a plug with ground is used with an electrical outlet, having a spring which biases the wedge-driven positioning member outside the frame, and having a stopper which aligns with a stopper on the wedge-driven positioning members when no plug is used with the electrical outlet.

13. The framed tamper-resistant shutter method of claim 8, said method having an open frame that is a full version having the main shutter sub-assembly, the secondary shutter sub-assembly, and the ground pin lockout release mechanism used for plugs, both with and without a ground pin, and with plug blades not necessarily of the same orientation.

14. The framed tamper-resistant shutter method of claim 8, said method having an open frame that is a a short version having the main shutter sub-assembly and the ground pin lockout release mechanism used for plugs, both with and without a ground pin, and where the blades are of the same orientation.

* * * * *